United States Patent [19]

Fletcher

[11] 4,362,217

[45] Dec. 7, 1982

[54] DOWNHOLE SHEARERS

[76] Inventor: Frederick Fletcher, 43 Chepstow Rd., Grange Park, Blackpool, Lancashire, England

[21] Appl. No.: 143,453

[22] Filed: Apr. 24, 1980

[30] Foreign Application Priority Data

Oct. 25, 1979 [GB] United Kingdom ..... 7936965

[51] Int. Cl.[3] ..... E21B 10/26

[52] U.S. Cl. ..... 175/402; 175/171; 175/257

[58] Field of Search ..... 175/402, 257, 246, 171, 175/172, 356; 166/55.6, 55.7, 55.1

[56] References Cited

U.S. PATENT DOCUMENTS

| | | | |
|---|---|---|---|
| 2,764,388 | 9/1956 | Camp | 175/356 X |
| 2,771,275 | 11/1955 | Ortloff | 175/356 X |
| 3,169,591 | 2/1965 | Worthington et al. | 175/297 |
| 3,346,059 | 10/1967 | Svendsen | 175/246 |
| 3,447,340 | 6/1969 | Garrett | 175/321 X |
| 3,965,996 | 6/1976 | Gross | 175/171 |

FOREIGN PATENT DOCUMENTS

| | | | |
|---|---|---|---|
| 1068638 | 5/1967 | United Kingdom | 175/257 |

*Primary Examiner*—William F. Pate, III
*Attorney, Agent, or Firm*—Gipple & Hale

[57] ABSTRACT

The present specification describes and claims a downhole casing shearer for use in drilling bore holes. The casing shearer comprises an elongate, generally cylindrical sub-member which is connected between a drilling bit and a drill rod string and which engages within a hollow cylindrical shearer, the trailing end of the shearer being connected to a conventional bore hole liner, so that the shearer may rotate about its longitudinal axis with the liner stationary. The sub-member and shearer are interlocked by a releasable locking mechanism which prevents relative rotation therebetween but which allows both for the axial drilling pressure to be applied to the shearer and the shearer to be lifted, and for the drilling bit, sub-member and rod string to be lifted through the liner leaving the shearer and liner in the bore hole, when the locking mechanism is released.

16 Claims, 4 Drawing Figures

DOWNHOLE SHEARERS

DESCRIPTION

The present invention relates to a downhole casing shearer for use, for example, in the exploration, mining, water well and construction industries.

Known downhole shearers comprise a drilling bit connected to the end region of an elongate rod string which serves to drive the drilling bit. Rotation of the rod string rotates the drilling bit and causes the required hole to be drilled. As the hole is drilled deeper, the length of the rod string is increased by connecting extra rod string sections to the existing rod string, as required.

Drilling can be and is as deep as several hundred meters and thus different types of strata have usually to be drilled through. Certain strata can be hostile insofar as they consist of overburdened formations which tend to close off the hole once the drilling bit has passed therethrough. When the hole has been drilled to the required depth the rod string and drilling bit are retracted and a cylindrical casing liner is inserted into the hole. However, difficulties can arise especially in the case of overburdened strata, both while retracting the rod string and drilling bit, and while inserting the liner, the overburdened strata having to be drilled away. These difficulties clearly waste time and cost money.

The aim of the present invention is to provide a downhole casing shearer which enables the drilling bit to be easily retracted when required, and the casing liner to be easily inserted into the hole.

According to the present invention there is provided a downhole casing shearer comprising a sub member and a hollow cylindrical shearer, the sub member being adapted to be connected between a drilling bit and a drilling rod string and being insertable at least partially within the shearer. A releasable locking means is provided on the sub member for locking the sub member and shearer together to prevent relative rotational movement, one end region of the shearer being connectible to a cylindrical casing liner for lining the bore in which the casing shearer is used.

In a preferred embodiment of the present invention the sub member is a generally cylindrical elongate member which is a snug, though slidable fit within the cylindrical shearer i.e. the external diameter of the sub member is slightly smaller than the internal diameter of the shearer. One end of the sub-member can be screwed to the end of a section of drilling rod string and the other end of the sub member can be screwed to a drilling bit. The sub member is preferably made of high quality drill collar steel and has a central, axially extending through bore via which fluid for cooling purposes and for conveying away cut material, can be passed during drilling. The said locking means comprises a pair of plungers which are retained in recesses in the sub member and which are spring biassed by coiled compression springs within the respective recesses, towards a position in which they project from the side wall of the sub member. The plungers are diametrically opposed with respect to the generally cylindrical sub member and can engage in complementary ports or apertures in the wall of the cylindrical shearer to thus prevent relative rotation therebetween. Alternatively suitable recesses in the inner wall of the shearer may replace the such ports. The plungers are preferably cylindrical though planar plungers or plungers or any other suitable configuration may be used, and each plunger is provided with a chamfered surface so that axial movement of the sub member relative to the shearer in one direction, will cause the plungers to retract into their respective recesses. The said one end region of the shearer is provided with rotational and thrust bearings for use in connecting the shearer to a conventional casing liner, said one end region being provided with cutting teeth or a hardened surface for reasons later discussed. The other end region of the shearer, which is, in use, nearest the drilling bit, is also provided with cutting teeth though merely a hardened surface may be sufficient dependent upon the nature of the material which is to be drilled.

Preferably further locking means are provided on the sub member nearer to the drilling bit end of the sub member than said first mentioned locking means. These further locking means are similar to the first mentioned locking means and are preferably provided at the same diametrically opposed positions on the sub member as the first mentioned locking means. However the plungers of said further locking means are designed so as to prevent relative axial movement between said sub member and shearer in said one direction, when the plungers have engaged in said ports, chamfers on the plungers allowing these further locking means to be disengaged in the direction opposite to said one direction.

In use, the sub member is connected both to a drilling rod string, preferably via a shock absorber which reduces impact loading and instantaneously applied torque, and to a drilling bit. The sub member is locked by said first mentioned locking means to the casing shearer so that rotation of the drilling bit also rotates the casing shearer, the external dimensions of the drilling bit being smaller than the internal diameter of the cylindrical casing shearer. Finally, the end of the casing shearer remote from the drilling bit is secured to an end of a conventional casing liner for a bore hole, the said rotational and thrust bearings allowing the casing shearer to rotate relative to the casing liner during a drilling operation.

With the above arrangement drilling can commence, the drilling bit and casing shearer cutting through the strata, the cut material being fluidised by liquid or air forced through the drilling rod string, the central bore in the sub member and the drilling bit, and being conveyed away via circulation channels defined between the sub member and casing shearer, and the annular gap between the casing liner and the drilling rod string. As drilling proceeds so the casing liner is dragged down the bore hole. At certain points where a particular section of liner or rod string, is virtually completely within the bore hole, the rod string can be retracted relative to the casing liner thus releasing said first mentioned locking means and subsequently engaging said further locking means. Further retraction of the rod string will then retract the casing shearer and casing liner so that further sections of liner can be attached, the teeth on the upper end of the shearer clearing any blocking material. By subsequently moving the rod string down the hole relative to the liner the first mentioned locking means can be re-engaged and drilling resumed. At the end of a drilling operation the drilling rod string is moved upwards relative to the casing shearer and lining sufficient to disengage the said first mentioned locking means but not to engage the said further locking means. The drilling rod string is then rotated through less than 180° so that the plungers of the further locking means are out of alignment with the ports in the shearer wall. Retraction of the rod string then allows the drilling bit to be moved easily up the shearer and liner leaving the shearer and liner in position in the bore hole. Clearly the prior art problems are overcome.

By pressurizing the casing liner the fluidised material can be forced between the outer wall of the shearer and liner, and the wall of the borehole to set the liner in a secure position.

The present invention will now be further described, by way of example, with reference to the accompanying drawings, in which:

DETAILED DESCRIPTION OF THE DRAWING

Figure 1:
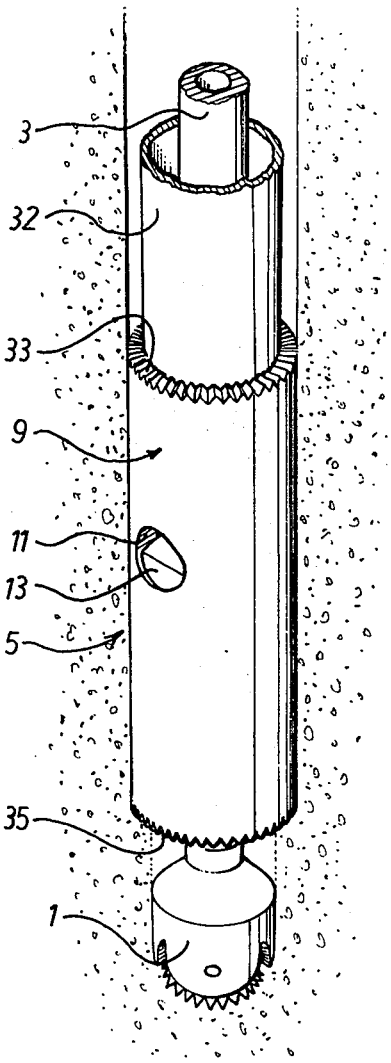
FIG. 1 is a perspective view of a preferred embodiment of a downhole casing shearer constructed according to the present invention.

The arrangement shown in the accompanying drawings basically comprises a drilling bit 1, a drilling rod string 3 and a downhole casing shearer 5 constructed according to the present invention.

The downhole casing shearer 5 comprises a sub-member 7 and a shearer 9, both of which are made of high quality drill collar steel. The sub-member 7 is generally cylindrical and the shearer 9 is a hollow cylindrical member the inside diameter of which is only slightly larger than both the diameter of the sub-member and the external dimensions of the drilling bit 1.

Figure 2:
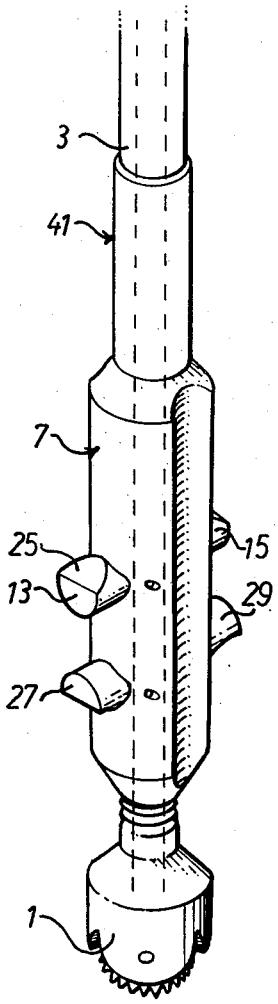
FIG. 2 is a perspective view of the shearer of FIG. 1 omitting the shearer casing.
Figure 3:
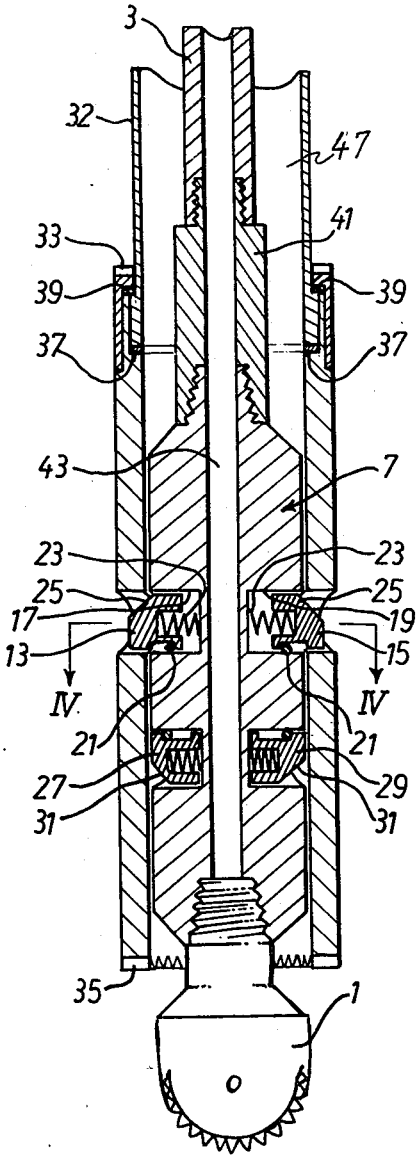
FIG. 3 is a vertical sectional view of the embodiment of FIG. 1.
Figure 4:
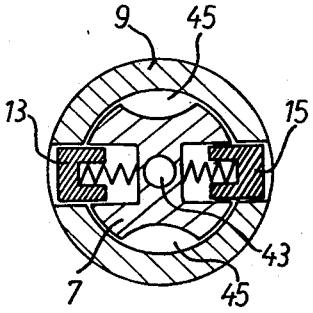
FIG. 4 is a horizontal sectional view of the embodiment of FIG. 1 along line IV—IV.

Two sets of locking means are provided on the sub member 7 and can engage with apertures 11 in the wall of the shearer 9. The first or upper locking means comprises two cylindrical plungers 13 and 15 which are retained in recesses 17 and 19 respectively by pins 21, the recesses being sited at diametrically opposed positions in the side wall of sub member 7 and housing compression springs 23 which bias the plungers to the radially outward position of FIGS. 2 and 3 wherein they engage in apertures 11. Each plunger 13,15 has a chamfered edge 25 which enables the plungers to be moved back into their respective recesses 17,19 if the sub member is moved upwards, as viewed in FIG. 3, relative to shearer 9. The second or lower locking means comprises two further spring biased plungers 27 and 29 which are also diametrically opposed with respect to each other and the axes of which are parallel to the axes of plungers 13 and 15. Thus axial movement of sub member 7 relative to shearer 9 in the upwards direction as viewed in FIG. 3, causes plungers 13 and 15 to retract and disengage apertures 11 and plungers 27 and 29 to subsequently engage in apertures 11. Chamfered surfaces 31 provided on plungers 27 and 29 allow sub member 7 to move downwards, as viewed in FIG. 3, to re-engage the said first locking means.

While the plungers 13,15,27 and 29 are illustrated as being cylindrical, they can of course be any suitable configuration e.g. planar, the only requirement being that they limit movement of the sub member relative to the shearer. Further, through apertures 11 can be replaced by suitable recesses on the inner wall of the shearer 9.

The inside diameter of the shearer 9 is identical to the inside diameter of a conventional casing liner 32 secured to one end thereof. Thus a smooth inner surface is presented between the shearer 9 and liner 32. The liner 32 has however only a wall thickness which is one half to two thirds the wall thickness of the shearer and the exposed edge of the shearer is provided with cutting teeth 33. Cutting teeth 35 are also provided on the other end of shearer 9 though teeth 33 and 35 can be replaced by hardened surfaces dependent upon the nature of the material being drilled. The connection between the shearer 9 and the liner 32 is by way of thrust bearing 37 and rotational bearing 39. Thus the bearings 37 can take the strain of forcing the drilling bit 1 downwards while the shearer 9 rotates and liner 32 does not.

In use, as illustrated in FIG. 1, drilling bit 1 is connected to one end of sub member 7 by a suitable screw connection, and the other end of sub member 7 is connected, also by suitable screw connections, to drilling rod string 3 via shock absorber unit 41. Shock absorber unit 41 reduces impact loading and torque on the bearings 37 and 39. This unit 41 which is a proprietory item, can however be omitted if so desired.

During normal drilling plungers 13 and 15 are engaged in apertures 11 causing shearer 9 to rotate. Thus drilling bit 1 and cutting teeth 35 cut the required bore. Cut material is fluidised and the bit and teeth cooled, by liquid forced under pressure down the rod string 3 which is hollow, through bores 43 in the shock absorber unit 41 and the sub member 7. The fluidised material is then passed through grooves 45 in the outer surface of the sub member 7 and through the annular space 47 between the liner 32 and the rod string 3, to the surface. Alternatively by pressurizing the liner 32, the fluidised material can be forced between the borehole and the outer surface of the liner to set the liner in position.

When additional lengths of liner 32 or rod string 3 have to be connected, drilling is stopped and the rod string is retracted relative to liner 32 and thus shearer 9. This movement causes plungers 13 and 15 to retract and plungers 27 and 29 to engage in apertures 11. Continued retraction of the rod string lifts the liner 32 and shearer 9 allowing additional liner sections to be connected. By subsequently lowering the drilling bit 1, plungers 13 and 15 are re-engaged in apertures 11 and drilling can recommence. Teeth 33 allow the liner 32 and shearer 9 to be retracted even if strata have moved against liner 32. If required liner 32 and shearer 9 can be fully retracted and a liner inserted, the larger diameter of shearer 9 allowing for any slight strata movement before the liner is inserted. However, it is intended that when drilling is complete the rod string is retracted relative to shearer 9 only sufficient to disengage plungers 13 and 15 from apertures 11 and not to engage the plungers of the second locking means. The rod string and shearer are then rotated through less than 180° to bring plungers 27 and 29 out of alignment with apertures 11, and the rod string, sub member and drilling bit are fully retracted through liner 31. Thus the casing liner is simply located and the drilling bit is easily removed.

The present invention thus simplifies downhole drilling removing at least some of the previously encountered problems.

I claim:

1. A downhole casing shearer for use in drilling bore holes, comprising a sub-member and a hollow cylindrical shearer, the sub-member being adapted to be connected between a drilling bit and a drilling rod string and being insertable at least partially within the shearer, releasable locking means being provided for locking the sub-member and shearer together to prevent relative rotational movement therebetween, one end region of the shearer being provided with rearwardly directed teeth, said shearer further being adapted to be rotationally connected to a casing liner for lining the bore in which the shearer is used enabling the shearer to rotate while the liner moves axially in the bore.

2. A downhole casing shearer according to claim 1, wherein the releasable locking means restricts axial movement of the sub-member relative to the shearer in one direction, axial movement in the opposite direction releasing said locking means.

3. A downhole casing shearer according to claim 2, wherein the said locking means comprises a pair of plungers which project laterally from the sub-member and which can engage in correspondingly located receiving means in the shearer wall, the plungers being retractable into recesses within the sub-member against the force of a spring.

4. A downhole casing shearer according to claim 3, wherein the plungers are diametrically opposed with respect to the sub-member.

5. A downhole casing shearer according to claim 3, wherein the plungers have a chamfered edge to allow axial movement of the sub-member relative to the shearer in said one direction, to retract the plungers.

6. A downhole casing shearer according to claim 1, wherein further locking means are provided on the sub-member nearer to the drilling bit connection end of the sub-member than said locking means.

7. A downhole casing shearer according to claim 6, wherein said further locking means comprises a pair of plungers which project laterally from the sub-member and which can engage in correspondingly located receiving means in the shearer wall, the plungers being retractable into recesses within the sub-member against the force of a spring.

8. A downhole casing shearer according to claim 7, wherein the plungers of said further locking means are diametrically opposed with respect to the sub-member.

9. A downhole casing shearer according to claim 7, wherein the plungers have a chamfered edge region to allow axial movement of the sub-member relative to the shearer.

10. A downhole casing shearer according to claim 6, wherein the two locking means each comprise a pair of plungers which project laterally from the sub-member and which can engage in correspondingly located receiving means in the shearer wall, the plungers being retractable into recesses within the sub-member against the force of a spring, the plungers of said locking means having a chamfered edge region allowing for relative axial movement between the sub-member and shearer from a locked position in one axial direction and the plungers of said further locking means having a chamfered edge region allowing for relative axial movement between the sub-member and shearer in the opposite axial direction.

11. A downhole casing shearer according to claim 10, wherein the plungers of the two locking means are arranged with their respective axes of movement parallel to each other.

12. A downhole casing shearer according to claim 11, wherein the plungers of the two locking means utilise the same receiving means in the shearer wall.

13. A downhole casing shearer according to claim 1, wherein said rearwardly directed teeth comprise cutting teeth provided on at least one end region comprising an end region of the shearer.

14. A downhole casing shearer according to claim 1, wherein a cylindrical casing liner is secured to one end of the shearer via rotational and thrust bearings.

15. A downhole casing shearer according to claim 1, wherein one end of the sub-member is attached to a drilling string via a shock absorber unit, the other end of the sub-member being connected to a drilling bit.

16. A downhole casing shearer according to claim 2, wherein the sub-member is elongate and generally cylindrical, with at least one axially extending circulation groove provided in its outer surface.

* * * * *